United States Patent [19]

Lewis et al.

[11] 4,215,794

[45] Aug. 5, 1980

[54] TAB FOR EASY-OPEN CAN END

[75] Inventors: Leon L. Lewis, Butler; Michael V. Murray, Monroeville, both of Pa.

[73] Assignee: United States Steel Corporation, Pittsburgh, Pa.

[21] Appl. No.: 53,623

[22] Filed: Jun. 29, 1979

[51] Int. Cl.[2] ..... B65D 41/32

[52] U.S. Cl. ..... 220/270

[58] Field of Search ..... 220/269–273

[56] References Cited

U.S. PATENT DOCUMENTS

| | | | |
|---|---|---|---|
| 3,963,143 | 6/1976 | Anderson et al. | 220/270 X |
| 3,967,753 | 7/1976 | Cudzik | 220/269 |

*Primary Examiner*—George T. Hall

*Attorney, Agent, or Firm*—Walter P. Wood

[57] ABSTRACT

A tab for an easy-open can. The tab carries an anodic insert of zinc, zinc-plated steel or equivalent to prevent corrosion. The insert underlies the tab where white rust which forms on zinc is hidden from view.

4 Claims, 5 Drawing Figures

TAB FOR EASY-OPEN CAN END

This invention relates to an improved tab for an easy-open can.

The tab is particularly useful for cans in which the segment cut from the can end remains attached when the can is opened, thus forestalling littering. Usually the ends of such cans are aluminum, and they have a score line which defines a segment to be punched inwardly of the can. A tab is riveted to the can end adjacent the score line and may be lifted to apply leverage to the material within the score line, and thus punch it inwardly.

There is a problem in constructing a tab which has sufficient mechanical strength and yet does not corrode. A special aluminum alloy has been used, but is in short supply. Tinplate has not been satisfactory because a tinplate tab rusts around its exposed untinned edges. Zinc-coated steel has been used, but shows unsightly white rust unless lacquered.

An object of our invention is to provide an improved tab which can be formed either of tinplate or blackplate, but does not rust or otherwise become corroded.

A more specific object is to provide an improved tab of tinplate or blackplate which carries a hidden anodic insert of zinc or zinc-plated steel or equivalent to prevent corrosion of either the tab or the can end.

Figure 1:
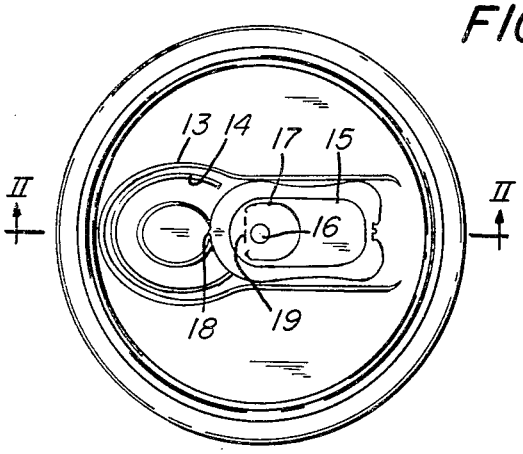
FIG. 1 is a top plan view of a can of the type to which our invention is applicable.
Figure 2:
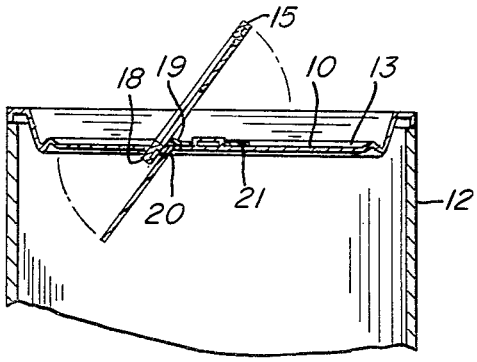
FIG. 2 is a vertical section on line II—II of FIG. 1, but showing the can opened.

FIGS. 1 and 2 show a portion of an easy-open can which includes an end 10 and a cylindrical side wall 12. The end and side wall may be aluminum, tinplate or blackplate and may be lacquered or not. The end has a depressed area 13 and a score line 14 within the depressed area. A tab 15 is affixed to the end, preferably with an integral rivet 16, also within the depressed area. The tab itself has an arcuate cut 17 extending part way around the rivet, and a point 18 overlying the area of the end within the score line 14. The tab may be lifted to open the can. The tab comes apart at its cut 17 and bends along a line 19. The point 18 bears downwardly against the area within the score line 14 and thus punches this portion of the end inwardly, as shown in FIG. 2. The punched portion remains attached through a neck 20. Can ends of this construction are known and not claimed to be of our invention.

Figure 3:
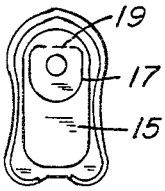
FIG. 3 is a bottom plan view of the tab without the anodic insert.
Figure 4:
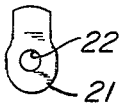
FIG. 4 is a bottom plan view of the anodic insert.
Figure 5:
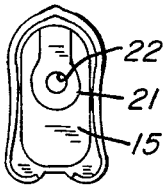
FIG. 5 is a bottom plan view of the tab with the insert applied.

In accordance with our invention, we apply a small anodic insert 21 to the underside of the tab 15, as shown in FIGS. 3, 4 and 5. The insert may be of zinc, zinc-plated steel or other anodic material. The insert lies within the area defined by the cut 17 and bend line 18. The insert has a hole 22 to receive the rivet 16. The insert underlies the portion of the tab which remains against the can end when the tab is lifted. Hence unsightly white rust (zinc oxide) which forms on zinc is hidden from view.

If the tab is tinplate, the insert effectively provides anodic protection to the exposed untinned edges and at the score line. The insert can serve also to protect a blackplate tab or a can end of tinplate or blackplate. Otherwise a tinplate end is subject to corrosion at the score line.

We claim:

1. In an easy-open can end which carries a tab for punching a portion of the can end inwardly to open the can, the improvement in which said tab has an anodic insert to prevent corrosion of the can end or tab.

2. A can end as defined in claim 1 in which said insert is of zinc or zinc-plated steel.

3. A can end as defined in claim 1 in which said insert underlies said tab where it is hidden from view.

4. A can end as defined in claim 1 in which said tab is of tinplate or blackplate.

* * * * *